US006696795B1

(12) United States Patent
Wang

(10) Patent No.: US 6,696,795 B1
(45) Date of Patent: Feb. 24, 2004

(54) DAMPING AND MUFFLING STRUCTURE FOR EL DEVICE

(75) Inventor: Chih Yuan Wang, Taichung Hsien (TW)

(73) Assignee: Wintek Corporation, Taichung (TW)

( * ) Notice: Subject to any disclaimer, the term of this patent is extended or adjusted under 35 U.S.C. 154(b) by 0 days.

(21) Appl. No.: 10/339,389

(22) Filed: Jan. 10, 2003

(51) Int. Cl.[7] ..... G09G 3/10
(52) U.S. Cl. ..... 315/169.3; 428/690
(58) Field of Search ..... 315/169.3, 224, 315/506; 428/690, 917, 425, 323, 328, 447, 493, 329

(56) References Cited

U.S. PATENT DOCUMENTS 3,894,169 A * 7/1975 Miller ..... 428/414
5,993,932 A * 11/1999 Friedl et al. ..... 428/71
6,351,068 B2 * 2/2002 Yamazaki et al. ..... 313/506
6,459,211 B1 * 10/2002 Wang ..... 315/169.3

* cited by examiner

*Primary Examiner*—James Clinger
*Assistant Examiner*—Chuc Tran
(74) *Attorney, Agent, or Firm*—Rosenberg, Klein & Lee

(57) ABSTRACT

A damping and muffling structure for EL device includes a transparent front electrode layer, a lighting layer, an inducing layer, a back electrode layer and a packaging layer which are sequentially overlaid on the front electrode layer. A damper made of de-static material is disposed on one face of the EL device distal from the front electrode layer. An insulating layer is disposed between the damper and the back electrode layer. The damper has an area sufficient for covering the bus bar of the front electrode layer. The damper is connected to a grounding pole of a driving circuit for quickly removing the charge so as to achieve damping effect and minify or even eliminate the vibration and noise caused by AC electric field.

6 Claims, 6 Drawing Sheets

DAMPING AND MUFFLING STRUCTURE FOR EL DEVICE

BACKGROUND OF THE INVENTION

The present invention is related to a damping and muffling structure for EL device, and more particularly to a damping and muffling structure which is made of de-static material for quickly removing the charge so as to achieve damping effect and minify or even eliminate the vibration and noise.

A conventional electro luminescent cell (EL cell) is a thin sheet and mainly used as backlight cell of PDA, mobile phone, etc. FIG. 6 shows a conventional EL cell composed of a transparent substrate 81, a front electrode layer 82, a lighting layer 83, an inducing layer 84, a back electrode layer 85 and an insulating layer 86. By means of a driving circuit, an AC voltage is applied to the front and back electrode layers 82, 85 to make the lighting layer 83 emit light.

Due to AC electric field, a lighting particle 831 of the lighting layer 83 are energized and vibrated to emit noise. This affects the quality of the EL cell.

In order to solve the problems of vibration and noise of the lighting layer 83 of conventional EL cell, generally the EL cell is backed to increase the thickness thereof so as to minify the vibration and noise. Alternatively, the EL cell is tightly attached to the circuit board to reduce vibration and noise.

However, the EL cell applied to small-size electronic products such as mobile phones is limited in thickness specification. Therefore, the backing will lead to excessive thickness. On the other hand, the EL cell can be attached to the circuit board to reduce over 60% noise. However, it is difficult to assemble the module and the use of double-face tape will lead to increased cost.

SUMMARY OF THE INVENTION

It is therefore a primary object of the present invention to provide a damping and muffling structure for EL device. The damping and muffling structure includes a damper for conducting the charge concentrating around the bus bar so as to minify or even eliminate the vibration and noise caused by AC electric field.

According to the above object, the damping and muffling structure of the present invention includes a transparent substrate, a transparent front electrode layer, a lighting layer, an inducing layer and a back electrode layer which are sequentially overlaid on the transparent substrate. The lighting layer, inducing layer and back electrode layer are enclosed by a packaging layer. A bus bar is disposed on one side of the front electrode layer. The bus bar and the back electrode layer are connected to a driving circuit which via AC voltage drives the lighting layer to emit light.

A damper made of de-static material is disposed on one face of the packaging layer distal from the front electrode layer. An insulating layer is disposed between the damper and the back electrode layer. The damper has an area sufficient for covering the bus bar of the front electrode layer. The damper is connected to a grounding pole of a driving circuit for quickly removing the charge so as to achieve damping effect and minify or even eliminate the vibration and noise caused by AC electric field.

The present invention can be best understood through the following description and accompanying drawings wherein:

DETAILED DESCRIPTION OF THE PREFERRED EMBODIMENTS

Figure 1:
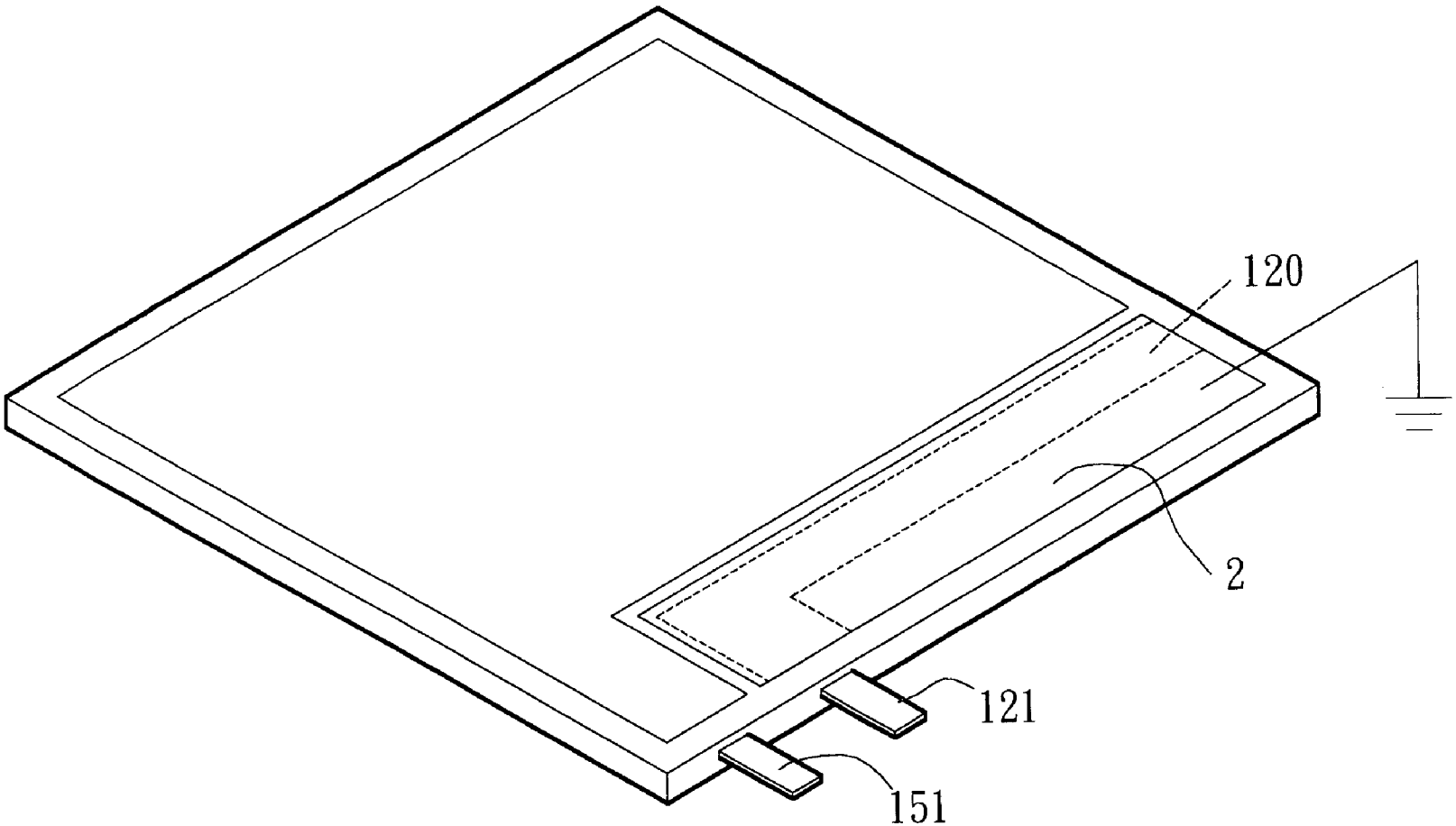
FIG. 1 is a perspective view of a first embodiment of the present invention.
Figure 2:
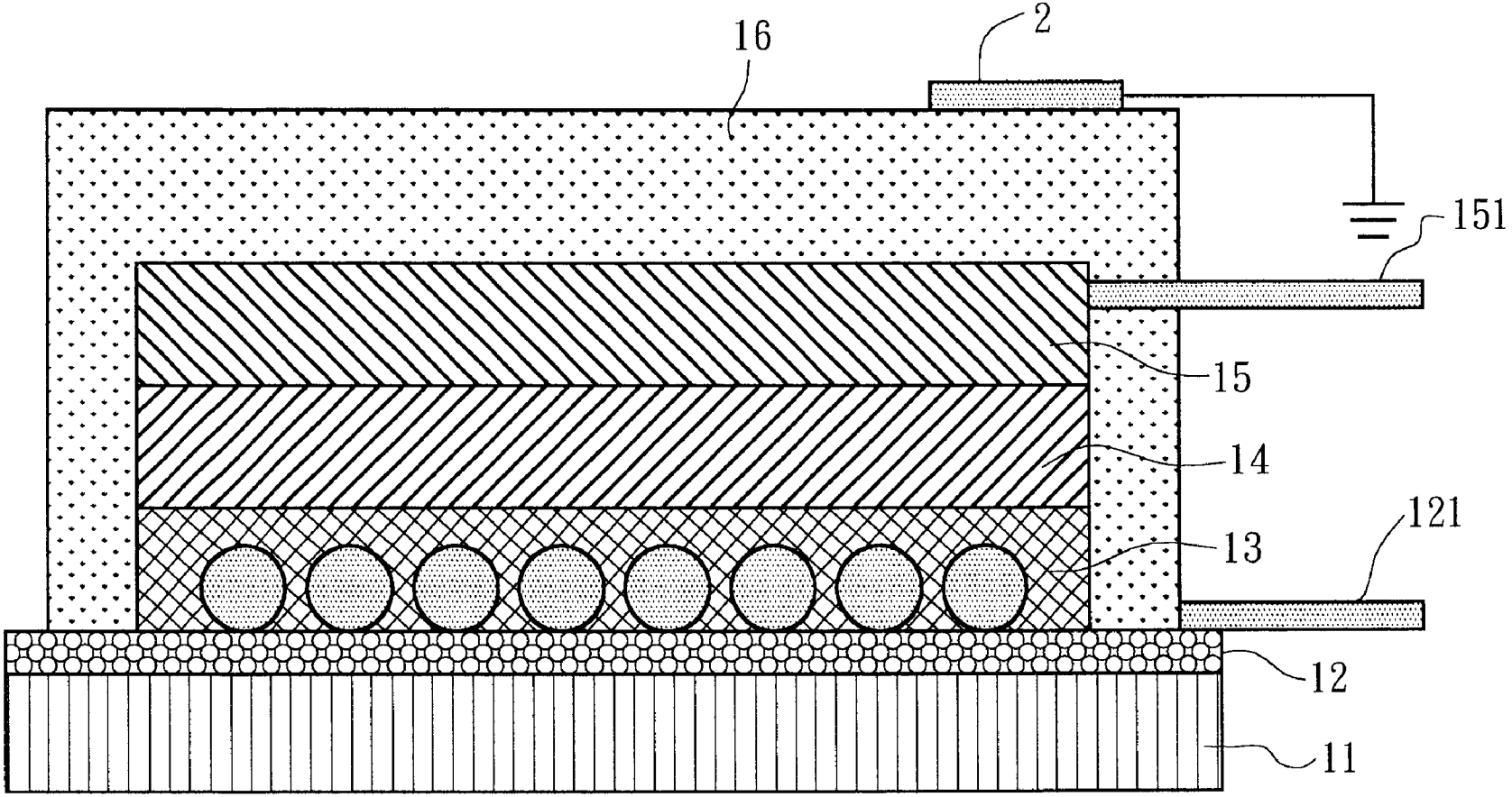
FIG. 2 is a sectional view of the first embodiment of the present invention.
Figure 3:
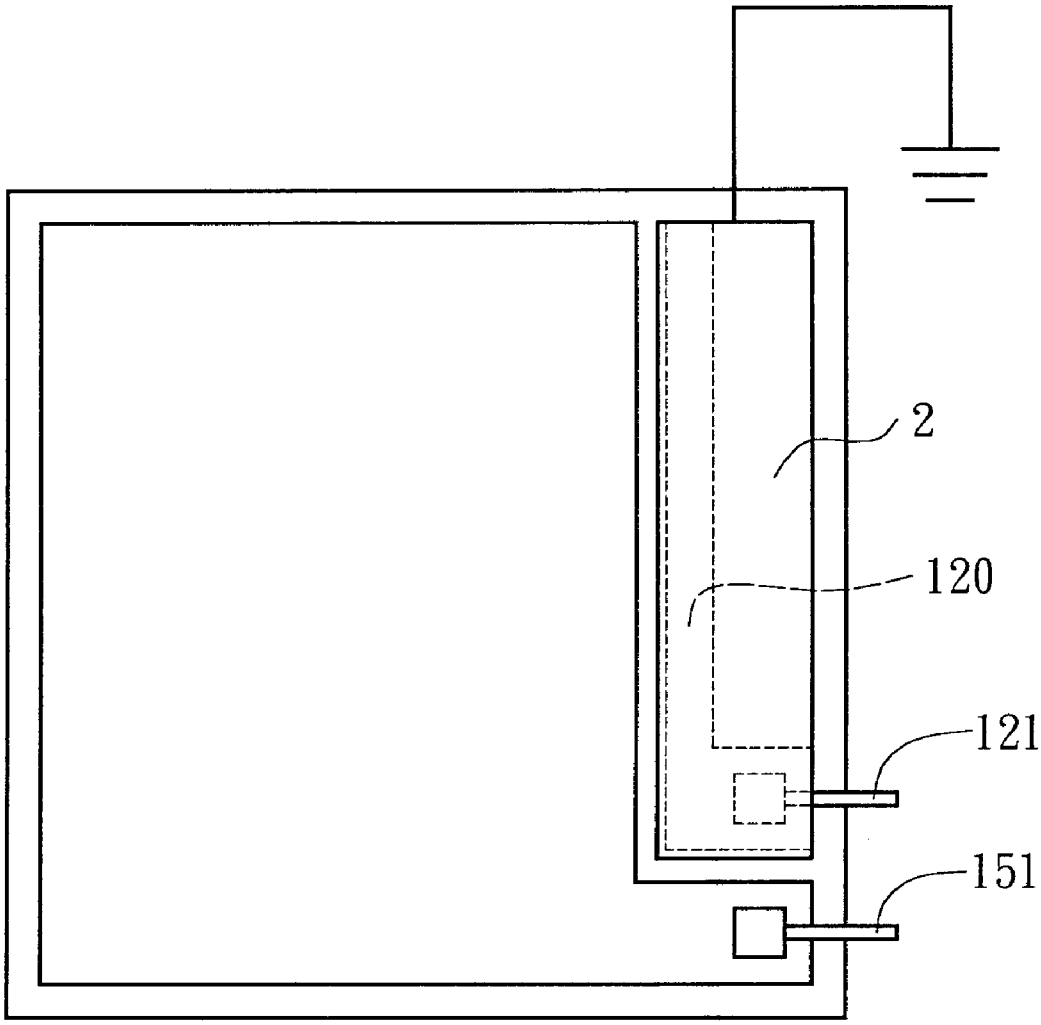
FIG. 3 is a top view of the first embodiment of the present invention, showing that the damper covers the bus bar of the front electrode layer.

Please refer to FIGS. 1 to 3. The damping and muffling structure for EL device of the present invention includes a transparent substrate 11, a transparent front electrode layer 12 (which in this embodiment is ITO bus bar), a lighting layer 13 composed of numerous lighting particles, an inducing layer 14 and a back electrode layer 15 which are sequentially overlaid on the substrate 11. The lighting layer 13, inducing layer 14 and back electrode layer 15 are enclosed by a packaging layer 16 which is made of insulating material. A bus bar 120 (which is generally silver gum; carbon gum or metal) is disposed on one side of the front electrode layer 12. The bus bar 120 and the back electrode layer 15 are respectively connected with two conductive terminals 121, 151 extending out from the transparent substrate 11. A driving circuit (not shown) is connected with the conductive terminals 121, 151 to apply AC between the front electrode layer 12 and back electrode layer 15 for driving the lighting layer 13 to emit light.

A damper 2 is disposed on one face of the packaging layer 16 distal from the front electrode layer 12. The damper 2 is made of de-static material. The damper 2 is insulated from the back electrode layer 15 by the insulating packaging layer 16. In this embodiment, the damper 2 is made of metallic conductive material. The area of the damper 2 is sufficient for covering the bus bar 120 of the front electrode layer 12, while not covering the two conductive terminals 121, 151 as shown in FIG. 2. In addition, the damper 2 is connected to the grounding pole of the driving circuit. (The grounding is denoted by the grounding symbol.)

The EL cell can be deemed a capacitor sheet. Therefore, when the driving circuit applies AC voltage between the front electrode layer 12 and the back electrode layer 15 for driving the lighting layer 13 to emit light, an AC electric field is generated on the EL cell. Accordingly, due to the electric field, the dielectric media of the front electrode layer 12, lighting layer 13, inducing layer 14 and back electrode layer 15 of the EL cell will be unevenly distributed. This results in regular buzz, that is, noise. The damper 2 of the present invention is made of metal material and is able to conduct the charge. The damper 2 covers the bus bar 120 of the front electrode layer 12 and is connected with the grounding pole of the driving circuit. Therefore, the denser charge generated around the bus bar 120 of the front electrode layer 12 can be quickly conducted to the grounding position so as to reduce the charge concentrated around the bus bar 120 of the front electrode layer 12. Accordingly, the charge generating vibration wave in this position is weakened or even eliminated. Also, the charge of the entire EL cell is more evenly distributed so as to minify the noise or even eliminate the noise. Accordingly, the damper 2 of the present invention serves to reduce or even eliminate the vibration and noise caused by the AC electric field.

Figure 4:
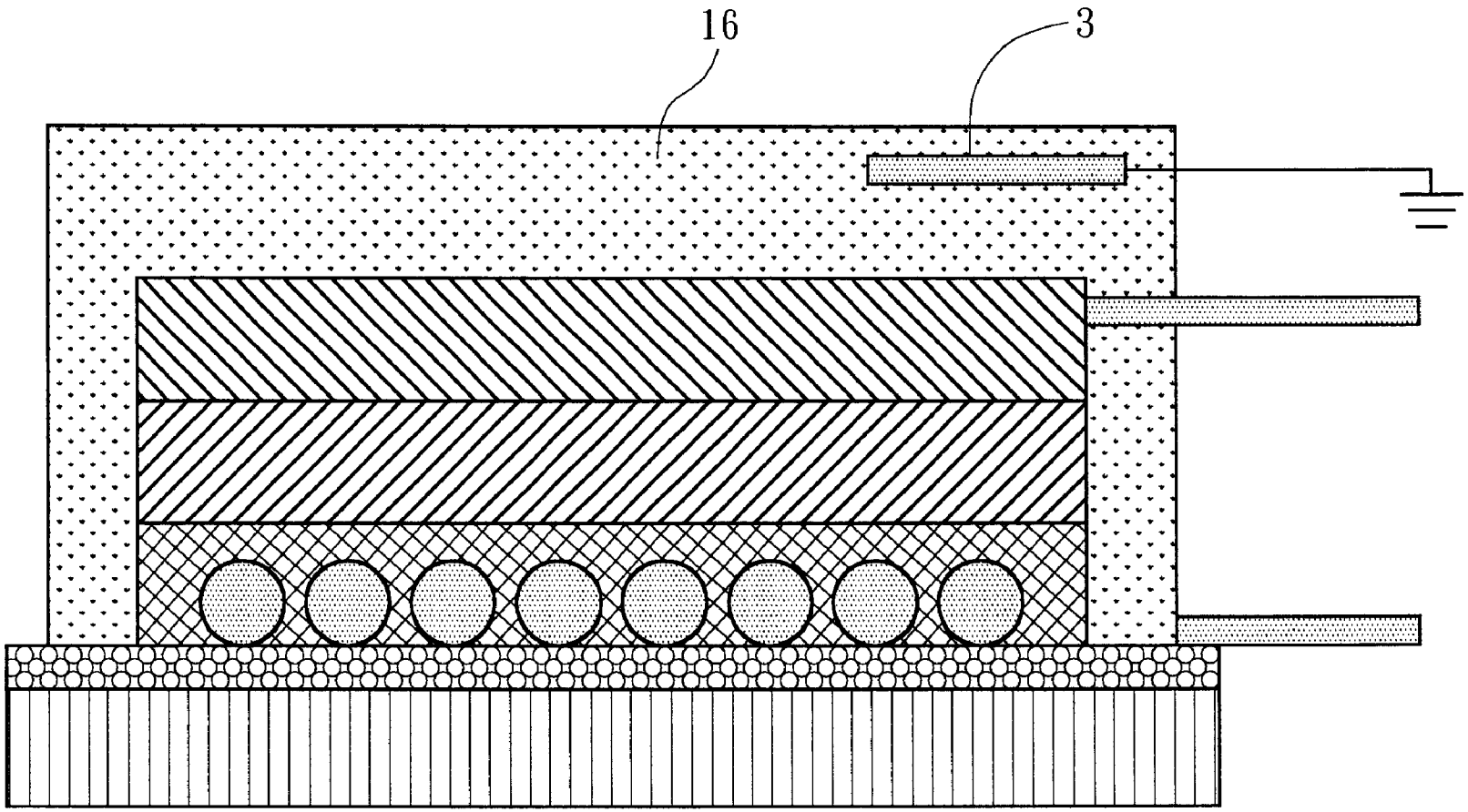
FIG. 4 is a sectional view of a second embodiment of the present invention.

FIG. 4 shows a second embodiment of the present invention, in which the damper 3 is inlaid in the packaging layer 16 made of insulating material so that the total thickness of the EL device will not be increased. This can achieve the same effect as the first embodiment.

The damper can be alternatively made of conductive polymer material so as to quickly eliminate the charge.

Figure 5:
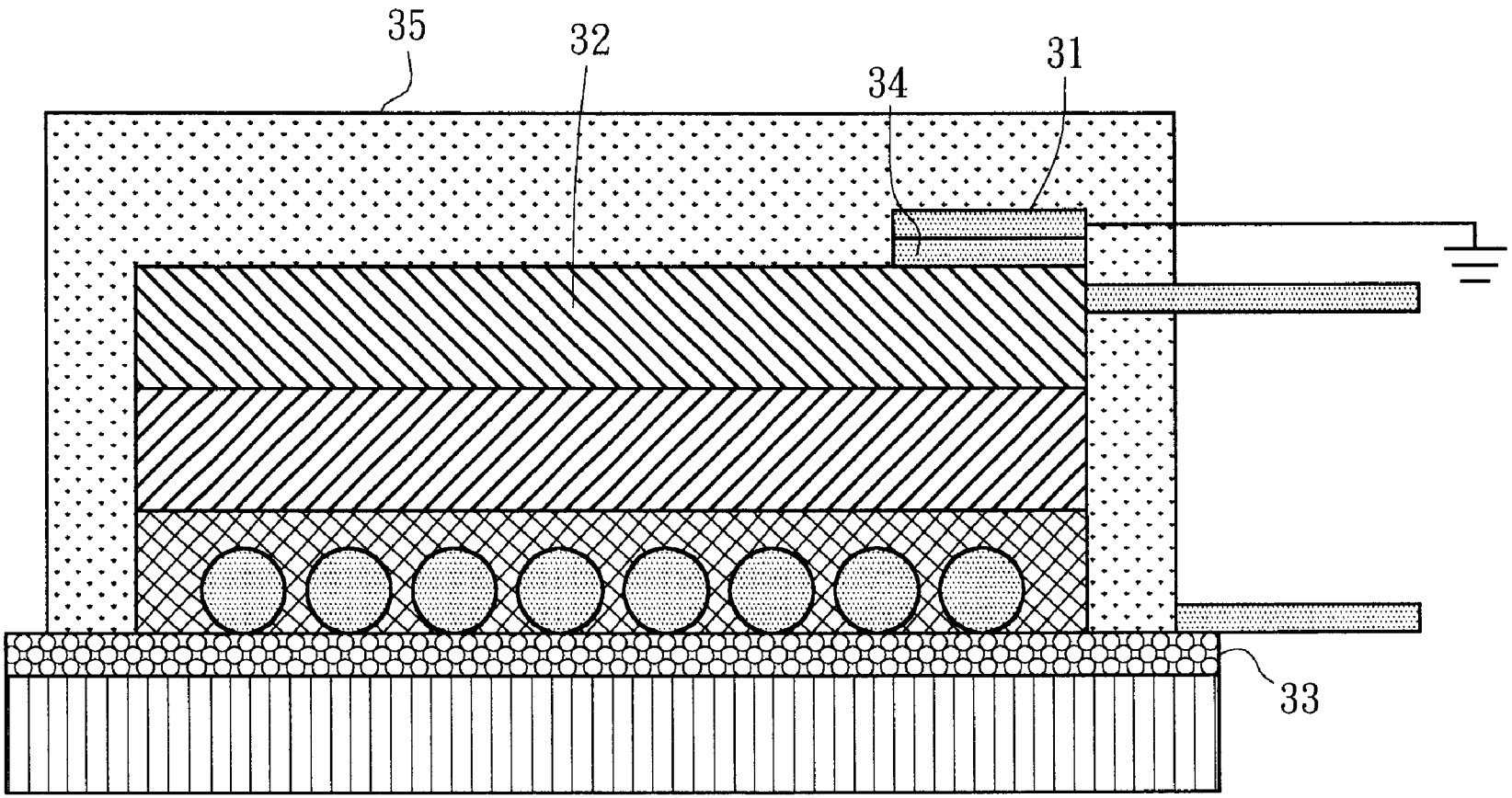
FIG. 5 is a sectional view of a third embodiment of the present invention.
Figure 6:
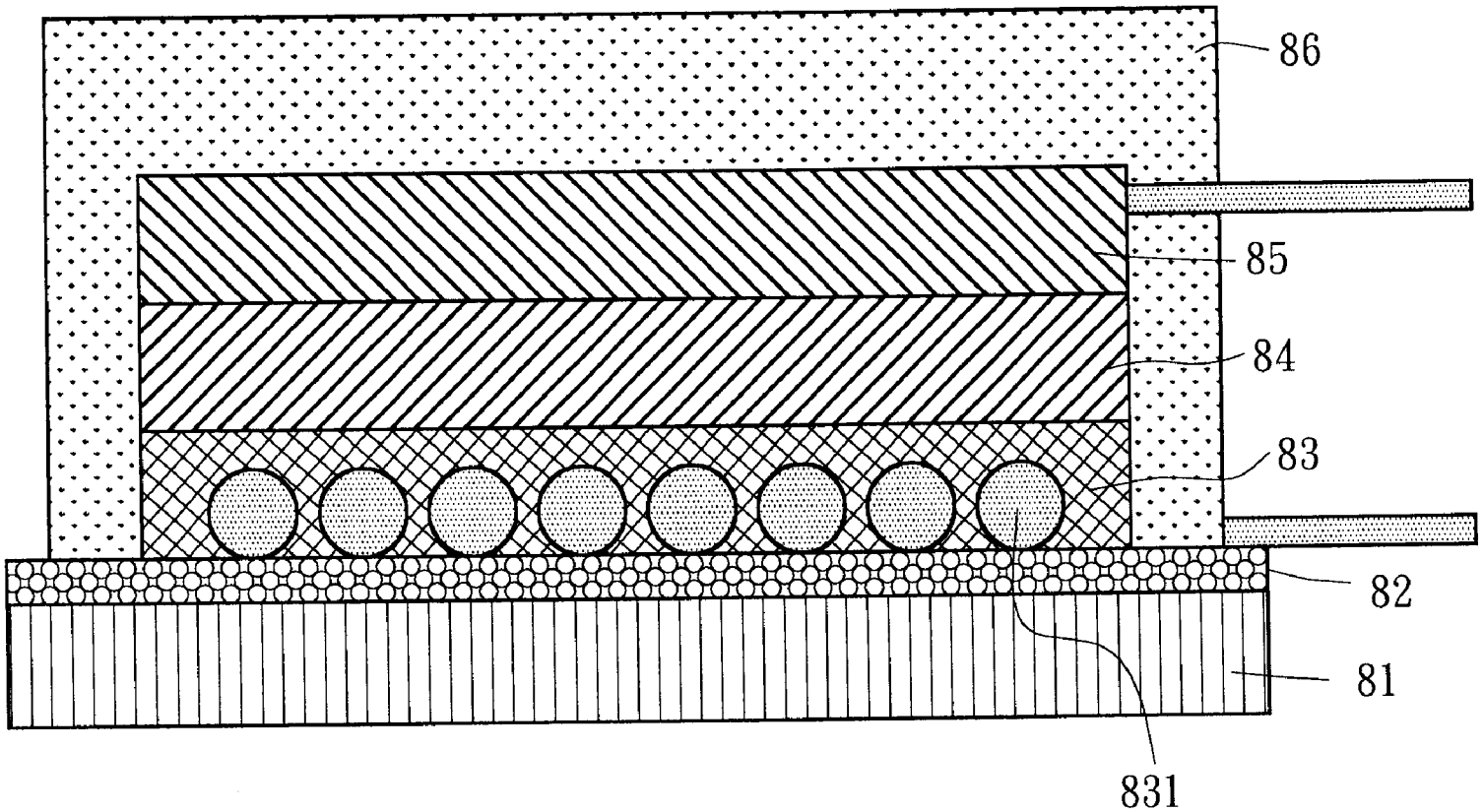
FIG. 6 PRIOR ART
FIG. 6 is a sectional view of a conventional EL cell.

FIG. 5 shows a third embodiment of the present invention, in which the damper 31 is still well insulated from the back electrode layer 32. The insulating layer 34 is painted on one face of the back electrode layer 32 distal from the front electrode layer 33. The damper 31 is disposed on the insulating layer 34. In addition, the back electrode layer 32 and the damper 31 is enclosed by the packaging layer 35 for keeping a good insulating effect for the damper.

The above embodiments are only used to illustrate the present invention, not intended to limit the scope thereof. Many modifications of the above embodiments can be made without departing from the spirit of the present invention.

What is claimed is:

1. A damping and muffling structure for EL device, comprising a transparent substrate, a transparent front electrode layer, a lighting layer, an inducing layer and a back electrode layer which are sequentially overlaid on the substrate, the lighting layer, the inducing layer and the back electrode layer being enclosed by a packaging layer, a bus bar being disposed on one side of the front electrode layer, the bus bar and the back electrode layer being connected to a driving circuit which via AC voltage drives the lighting layer to emit light, a damper being disposed on one face of the packaging layer distal from the front electrode layer, an insulating structure being disposed between the damper and the back electrode layer, the damper being made of de-static material, the damper having an area sufficient for covering the bus bar of the front electrode layer, the damper being connected to a grounding pole of the driving circuit.

2. The damping and muffling structure for EL device as claimed in claim 1, wherein the damper is attached to one face of the packaging layer distal from the front electrode layer.

3. The damping and muffling structure for EL device as claimed in claim 1, wherein the packaging layer is made of insulating material and the damper is inlaid in the packaging layer, whereby the packaging layer serves as the insulating layer.

4. The damping and muffling structure for EL device as claimed in claim 1, wherein the insulating layer is disposed on one face of the back electrode layer distal from the front electrode layer for insulating the damper from the back electrode layer.

5. The damping and muffling structure for EL device as claimed in claim 1, wherein the damper is made of metal or conductive polymer material.

6. The damping and muffling structure for EL device as claimed in claim 1, wherein the bus bar and the back electrode layer are respectively connected with two conductive terminals extending out from the transparent substrate, the conductive terminals being connected with the driving circuit.

* * * * *